United States Patent [19]

Rankel

[11] 4,404,091

[45] Sep. 13, 1983

[54] TREATMENT OF SHALE OILS

[75] Inventor: Lillian A. Rankel, Plainsboro, N.J.

[73] Assignee: Mobil Oil Corporation, New York, N.Y.

[21] Appl. No.: 314,939

[22] Filed: Oct. 26, 1981

[51] Int. Cl.[3] ..... C10G 9/00; C10G 31/00

[52] U.S. Cl. ..... 208/131; 208/126; 208/251 R

[58] Field of Search ..... 208/126, 127, 131, 251 R

[56] References Cited

U.S. PATENT DOCUMENTS

| | | | |
|---|---|---|---|
| 2,911,353 | 11/1959 | Watts et al. | 208/126 |
| 2,939,833 | 6/1952 | Wankat et al. | 208/251 R |
| 3,110,569 | 11/1963 | Carter | 208/251 R |
| 4,006,077 | 2/1977 | Wegner et al. | 208/251 R X |
| 4,029,571 | 6/1977 | Curtin | 208/251 R X |
| 4,082,650 | 4/1978 | Li | 208/131 |
| 4,088,567 | 5/1978 | White | 208/251 R X |
| 4,243,514 | 1/1981 | Bartholic | 208/251 R X |

*Primary Examiner*—Delbert E. Gantz
*Assistant Examiner*—Glenn A. Caldarola
*Attorney, Agent, or Firm*—Charles A. Huggett; James F. Powers, Jr.; John K. AboKhair

[57] ABSTRACT

Arsenic and Nitrogen Removal from shale oil by delayed coking in the presence of carbonaceous materials.

19 Claims, No Drawings

TREATMENT OF SHALE OILS

This invention relates to processing shale oil. It more particularly refers to a novel technique for removing certain impurities from shale oil.

It is known to produce shale oil by either above ground or in situ retorting whereby kerogen is separated from its entrapping rock (shale). This kerogen is somewhat different from most crude oils in that its impurity content, particularly its nitrogen and arsenic levels, is different. Further, shale derived kerogen generally has a higher boiling range than most crude oils.

It is known that shale derived kerogen can be initially thermally treated so as to separate both nitrogen and arsenic therefrom. This treatment also converts some of the heavier components to more desirable, lower boiling range products. Table I below shows a typical shale oil composition as produced as well as its composition after it has been conventionally thermally treated under typical delayed coking conditions of 850° F. for 20 hours:

| | Feed Paraho Shale Oil (PSO) | Treated PSO |
|---|---|---|
| Gas wt. % | — | 2.0 |
| Liquid wt. % | 100 | 88.2 |
| Coke wt. % | — | 9.8 |
| Elemental Analysis wt. % | | |
| C | 84.46 | 85.26 |
| H | 11.03 | 11.52 |
| N | 2.17 | 2.26 |
| O | 1.38 | 0.5 |
| S | 0.73 | 0.4 |
| As (ppm) | 32 | 10 (liquid) (23 ppm in coke) |
| Distillation Analysis wt. % | | |
| IBP-420° F. | 5.1 | 21.6 |
| 420-650 | 35.2 | 37.1 |
| 650-850 | 37.2 | 33.3 |
| 850-1075 | 20.1 | 8.1 |
| 1075+ | 2.4 | 0 |
| % conversion to 650° F.⁻ | | 30.8 |

It is an object of this invention to provide an improved process for purifying shale oil.

Other and additional objects will become apparent from a consideration of this entire specification including the claims appended hereto.

In accord with and fulfilling these objects, one aspect of this invention resides in thermally treating shale oil derived kerogen, under conventional delayed coking conditions, in admixture with separately added, preformed highly carbonaceous material which is substantially solid at normal temperatures and pressures. As used herein, reference to normally solid, highly carbonaceous materials includes cokes, coals, and other solid materials as well as very highly viscous materials such as asphaltenes which are predominantly solid coke but may have some distillable liquids associated therewith.

According to this invention, it is preferred that the normally solid, highly carbonaceous materials have themselves low or no arsenic content. Most preferably these coked carbonaceous solids are derived from processing crude oil through conventional delayed coking and/or alkane (propane) deasphalting processes. The "solid" products produced by such processing are highly carbonaceous, e.g., containing more than about 80 weight percent carbon; they contain significant amounts of nitrogen, depending upon their source; and often, but not always, contain heavy metals such as nickel and/or vanadium.

It has surprisingly been found that thermally co-treating raw shale oil with normally solid carbonaceous materials, under otherwise conventional conditions, results in an unexpected reduction in arsenic content coupled with an unexpected conversion of the raw shale oil to lighter, and therefore more desirable, product.

The process of this invention involves operations under conventional coking conditions. These can be batch or continuous as is per se well known. Suitable processing temperatures are about 700° F. to 950° F., preferably about 800° to 900° F. Pressure is not a significant operating variable, it usually being maintained at about 15 to 400 psig. In the case of batch, or delayed, coking, a suitable processing time is about 0.1 to 24 hours, preferably about 1 to 10 hours. In the case of continuous, or flexi coking, a suitable space velocity is about 0.5 to 50 LHSV preferably about 1 to 10 LHSV. Weight proportions of shale oil to normally solid carbonaceous material will suitably vary from about 100 to 1 to 1 to 1, preferably about 5 to 1.

The practice of this invention is exemplified by the thermal co-processing of Paraho shale oil with various cokes and/or asphaltenes as set forth in the following Table II. In these reported tests, about 5 to 7 parts by weight of raw shale oil was admixed with 1 part by weight of the particular normally solid carbonaceous material set forth. The admixture was maintained at about 850° F. for 20 hours after which time the product was analyzed as set forth. The shale oil used was the same as that reported in Table I above wherefore the results reported in both tables are comparable:

TABLE II

| | Feed PSO | PSO and Needle Coke | PSO and Resid Coke | PSO and Asphaltenes |
|---|---|---|---|---|
| Analysis weight % | | | | |
| Gas | | 6.6 | 2.1 | 2.0 |
| Liquid | 100 | 78.7 | 89.6 | 92.1 |
| Coke | | 14.8 | 8.3 | 5.9 |
| Elemental Analysis weight % | | | | |
| C | 84.46 | 84.69 | 84.07 | 83.38 |
| H | 11.03 | 11.87 | 11.10 | 11.48 |
| N | 2.17 | 1.80 | 1.65 | 1.81 |
| O | 1.38 | 1.09 | 1.98 | 2.20 |
| S | 0.73 | 0.76 | 0.77 | 0.89 |
| As(ppm) | 32 | 5 | 5 | 5 |
| Distillation Analysis weight % | | | | |
| IBP-420° F. | 5.1 | 10.5 | 12.7 | 4.8 |
| 420-650 | 35.2 | 60.5 | 48.8 | 60.9 |
| 650-850 | 37.2 | 26.3 | 34.3 | 34.3 |
| 850-1075 | 20.1 | 2.5 | 3.3 | 0.0 |
| 1075+ | 2.4 | 0.1 | 0.9 | 0.0 |
| % conversion | | | | |
| to 850° F.⁻ | | 26.3 | 58.3 | 73.7 |
| to 650° F.⁻ | | 51.4 | 35.5 | 42.5 |

The boiling range distribution of this asphaltene fraction is: 2.2% gas, 4.4% $C_5$-420° F., 5.9% 420°-650° F., 3.7% 650°-850° F., 83.7% solids (coke)

$$650^\circ\ F.^- \text{ conversion} = \frac{\text{gas} + \text{net } 650^\circ\ F.^- \text{ liquids}}{650^\circ\ F.^+ \text{ in charge}}$$

-continued $$850° \text{ F.}^- \text{ conversion} = \frac{\text{gas + net } 850° \text{ F.}^- \text{ liquids}}{850° \text{ F.}^+ \text{ in charge}}$$

The elemental analyses of the normally solid carbonaceous materials exemplified are:

TABLE III

| Element wt % | Needle Coke | Resid Coke | Asphaltenes |
|---|---|---|---|
| C | 93.65 | 83.59 | 85.65 |
| H | 2.17 | 3.30 | 6.84 |
| N | 0.447 | 1.47 | 1.30 |
| O | 1.26 | — | 0.49 |
| S | 0.62 | 5.40 | 5.94 |
| Ni(ppm) | — | 180 | 155 |
| V (ppm) | — | 730 | 830 |

It will become apparent from a consideration of the data presented that operating according to this invention results in significantly greater arsenic removal and significantly greater liquid yields than are achievable by prior art processes.

Consideration of these data shows that not only does this process remove arsenic from the liquid product, but that nitrogen is removed as well. This is of particular significance since most prior art denitrogenation processes consume substantial quantities of hydrogen. It is usual for hydrogen to be consumed at a rate of about 600 to 650 SCF/BBL for removal of 1% of the nitrogen content. These data show removal of about 0.4 to 0.6% nitrogen—up to about one quarter of the nitrogen—without added hydrogen. The savings in hydrogen amounts to about 300 to 350 SCF/BBL, which is significant. Of course, it is within the scope of this invention to denitrogenate the liquid product by post treating with added hydrogen with or without a denitrogenation catalyst. Hydrogen may also be co-fed during the process to increase the denitrogenation aspect thereof.

What is claimed is:

1. An improved process for the treatment of shale oil to remove contaminants therefrom, comprising the steps of:

(a) admixing the shale oil with preformed, normally solid carbonaceous material; and (b) subsequently thermally treating the mixture under delayed coking conditions to produce distillate products having reduced amounts of contaminants, wherein the reduction in contaminants is substantially greater than the reduction obtained by carrying out the thermal treatment in the absence of said preformed, normally solid carbonaceous material.

2. The process of claim 1 further resulting in the conversion of the shale oil to lighter products as compared to products obtained by carrying out the thermal treatment in the absence of said preformed carbonaceous material.

3. The improved process of claim 1 wherein said preformed, normally solid carbonaceous material is selected from the group consisting of coal, coke, asphaltenes, or any mixture thereof.

4. The improved process of claim 1 carried out batchwise at a temperature of about 700° F. to 950° F., at a pressure of about 15 to 400 psia for about 0.1 to 24 hours.

5. The improved process of claim 1 in which the ratio of solid carbonaceous material to shale oil is about 1:1 to about 1:100.

6. The improved process claimed in claim 1 carried out continuously.

7. The improved process claimed in claim 1 carried out under conditions which result in nitrogen removel from the liquid product.

8. The process of claim 1 wherein the contaminants comprise arsenic contaminants.

9. An improved process for the treatment of shale oil to remove arsenic contaminants therefrom comprising the steps of:

(a) admixing the shale oil with preformed, normally solid carbonaceous material, having an arsenic content substantially lower than the arsenic content of said shale oil;

(b) subsequently thermally treating said mixture under delayed coking conditions to produce distillate products having reduced amounts of arsenic contaminants wherein the reduction in arsenic contaminants is substantially greater than the reduction obtained by carrying out said thermal treatment in the absence of said preformed, normally solid carbonaceous material.

10. The improved process of claim 9 wherein said preformed, normally solid carbonaceous material is selected from the group consisting of coal, coke, asphaltenes, or any mixture thereof.

11. The improved process of claim 9 carried out batchwise at a temperature of about 700° F. to about 950° F., at a pressure of about 15 to 400 psia for about 0.1 to 24 hours.

12. The improved process of claim 9 in which the ratio of solid carbonaceous material to shale oil is about 1:1 to about 1:100.

13. The improved process of claim 9 carried out continuously.

14. The improved process of claim 9 carried out under conditions which result in nitrogen removal from the liquid product.

15. An improved process for the treatment of shale oil to remove arsenic and nitrogen contaminants therefrom, comprising the steps of:

(a) admixing the shale oil with carbonaceous material selected from the group consisting of coal, coke, asphaltines, or any mixture thereof; and (b) subsequently thermally treating said mixture under delayed coking conditions to produce distillate products having reduced amounts of arsenic and nitrogen contaminants wherein the reaction in arsenic and nitrogen contaminants is substantially greater than the reduction obtained by carrying out the thermal treatment in the absence of said carbonaceous material.

16. The process of claim 15 wherein the thermal treatment is carried out batchwise at a temperature of about 700° F. to about 950° F., at a pressure of about 15 to 400 psia for about 0.1 to 24 hours.

17. The improved process of claim 15 in which the ratio of solid carbonaceous material to shale oil is about 1:1 to about 1:100.

18. The improved process claimed in claim 15 carried out continuously.

19. The process of claim 15 wherein the distillate products are lighter than the products obtained by carrying out the thermal treatment in the absence of said carbonaceous material.

* * * * *